US005690411A

United States Patent [19]

Jackman

[11] Patent Number: 5,690,411

[45] Date of Patent: Nov. 25, 1997

[54] WEARABLE VEHICULAR SIGNALING SYSTEM ADAPTED AND AUGMENTED FOR WEARING ON OR ABOUT THE BODY OF A PERSON

[76] Inventor: Vernon L. Jackman, 30 Center St., Little Ferry, N.J. 07643-1803

[21] Appl. No.: 637,542

[22] Filed: Apr. 25, 1996

[51] Int. Cl.[6] ..... F21L 15/08

[52] U.S. Cl. ..... 362/103; 362/108

[58] Field of Search ..... 362/108, 103

[56] References Cited

U.S. PATENT DOCUMENTS

| | | | |
|---|---|---|---|
| D. 259,146 | 5/1981 | Carr, Jr. | D2/184 |
| D. 277,808 | 3/1985 | Nichols | D2/27 |
| 4,328,533 | 5/1982 | Paredes | 362/108 |
| 4,367,515 | 1/1983 | Beard | 362/103 |
| 4,412,205 | 10/1983 | Von Kemenczky | 340/331 |
| 4,480,293 | 10/1984 | Wells | 362/108 |
| 4,709,307 | 11/1987 | Branom | 362/103 |
| 4,812,953 | 3/1989 | Ask et al. | 362/103 |
| 5,070,436 | 12/1991 | Alaxander et al. | 362/108 |
| 5,113,325 | 5/1992 | Eisenbraun | 362/103 |
| 5,202,660 | 4/1993 | Hartman | 340/332 |
| 5,276,424 | 1/1994 | Hegemann | 340/321 |
| 5,278,734 | 1/1994 | Ferber | 362/103 |
| 5,307,251 | 4/1994 | Shaffer | 362/102 |
| 5,424,922 | 6/1995 | Wise | 362/108 |
| 5,477,998 | 12/1995 | Reckler | 224/151 |
| 5,488,361 | 1/1996 | Perry | 362/103 |

OTHER PUBLICATIONS

Bike Nashbar Catalog 112, Spring AGO Industries Mar. 1996 Nov. 1996 Reflective vest–p. 24 Weable lights–p. 58 Traffic Vests.

Root International Lum * A * Products Sivad Enterprises Dec. 1996 Nov. 1996 Lum * A * Vest Laser Safety clip on light.

Visibility Systems Company Mar. 1996 Lightman Safety Strobe Kit.

*Primary Examiner*—Carroll B. Dority

[57] ABSTRACT

A wearable vehicular signaling systems enables pedestrians, runners, joggers, bicyclists, skaters, roadway and highway repair persons, visually impaired persons, children, elderly persons, school patrol persons, traffic police officers, and others to communicate or signal an intention to commence, continue, or resume forward motion; to turn or bear to the right; to turn or bear to the left; to cross the roadway or highway; or stop, in a manner that would be seen and understood by the operators of oncoming vehicles. Drivers would not only see the person using this device, they would also know what he or she intended to do. The device can comprise of direction signaling light subassemblies which are shaped, colored, and oriented to create a meaningful signal when controllably actuated. These direction light can be supported by a vest-like garment. The shoulder straps and belts of this vest-like garment can by substantially adjustable in length so as to permit the device to be worn while the users is also wearing a backpack or similar item. A battery or batteries residing removably in a battery compartment supported by the vest-like garment may be used as a means for powering the direction signaling lights. A panel of switches may be used to controllably actuate the direction signaling light subassemblies. The switch panel may reside removably on the vest-like garment and could be provided with means whereby it may be temporarily secured to the handlebars of a bicycle. Some or all the elements of this direction signaling could be provided as kit for creating a customized wearable vehicular signaling system. Instead of a vest-like garment, the direction signaling light subassemblies could be arranged to create a wearable vehicular signaling system suitable for wearing about the arm or legs.

24 Claims, 9 Drawing Sheets

WEARABLE VEHICULAR SIGNALING SYSTEM ADAPTED AND AUGMENTED FOR WEARING ON OR ABOUT THE BODY OF A PERSON

BACKGROUND—FIELD OF INVENTION

This wearable vehicular signaling system relates generally to lighted safety apparel and vehicular signaling systems, and specifically to a wearable device useful for communicating an intention to commence, continue, or resume forward motion, to turn or bear to the right or left, to cross the roadway or highway, or to stop.

BACKGROUND—DESCRIPTION OF PRIOR ART

There have been and are many items of equipment and apparel intended for use by persons undertaking activities in areas that they must share with motorized vehicles, so that these persons will be seen by motorists and not accidentally injured or killed. Today, many of these persons wear bright colored or reflective clothing, in order to be visible to oncoming motorists. Furthermore, there have been and are garments equipped with means of illumination and lights that are portable or securable to an article of clothing.

U.S. Pat. No. 5,070,436, issued to Alexander et al Dec. 3, 1991, discloses a signal vest. Alexander et al is provided in front and back with flashable lights, provided solely as visibility means. The overall circuit in Alexander et al is divided into two separate sub-circuits, to assure the operation of some of the lights should one of these sub-circuits fail to operate.

U.S. Pat. No. 4,328,533, issued to Paredes May 5, 1982, discloses an illuminated safety harness. Like Alexander et al, lights in Paredes are provided solely as extended visibility means.

U.S. Pat. No. 5,488,361, issued to Perry Jan. 30, 1996, discloses a navigation lights device for personal watercraft. The lights in Perry enable observers to navigate around a user of Perry. These lights also indicate the position and immediate heading of the user of Perry.

Also among the related prior art:

U.S. Pat. No. 5,307,251, issued to Shaffer Apr. 26, 1994, discloses a pedestrian crossing safety device, intended to arrest the movement of traffic. U.S. Pat. No. 4,709,436, issued to Branson Nov. 24, 1987, discloses an article of clothing having an illuminated display sign on the backside thereof. U.S. Pat. No. 4,480,293, issued to Wells Oct. 30, 1984, discloses a lighted sweatshirt. U.S. Pat. No. 5,113,325, issued to Elsenbrawn May 12, 1992, discloses a light assembly kit for illuminating an article of clothing. U.S. Pat. No. 5,278,734, issued to Ferber Jan. 11, 1994, discloses light illuminating assemblies for wearing apparel with light element securement means. U.S. Pat. No. Des. 259,146, issued to Carr, Jr. May 12, 1981, discloses a combined vest and blinker lights. U.S. Pat. No. Des. 277,808, issued to Nichols Mar. 5, 1985, discloses a combined florescent and reflecting safety vest. U.S. Pat. No. 4,412,205, issued to Von Kemencsky Oct. 25, 1983, discloses a switching construction responsive to motions of a wearer. U.S. Pat. No. 5,424,922 issued to Wise Jun. 13, 1995, discloses fiber optic apparel and safety gear.

An Interact search for "reflective or illuminated garments . . . " discovered several Traffic Vests™, provided with PVC reflective tape. These items are offered for purchase by AGO Industries, Inc. Root International, Inc. sells a luminous vest and a luminous belt.

Bike Nashbar sells the Nathan Reflective Biking Vest™. Nashbar also sells the SL-20 Flashing Light™, Model 340C Yellow Clip Light™, and Model 300C Red Clip Light™.

With the exception of Perry, the foregoing references are intended for use by persons undertaking activities in areas that they must share with motor vehicles. Yet, none of these references enables users to communicate their intention to commence, continue, or resume forward motion, to turn or bear to the right or left, to cross the roadway, or to stop.

Nonetheless, motorists very often need to know how persons seen on or along the roadway intend to move or turn, in order to avoid injuring these persons. This lack of functionality in the prior art creates a safety gap and a legal gap.

A motorist may not know if a person seen nearby plans to move in a manner that may bring said person dangerously into the vehicle's path. Moreover, some states and municipalities have proposed or enacted laws requiring in-line skaters to wear reflective clothing and to honor traffic laws. The present invention enables compliance with such regulations.

OBJECTS AND ADVANTAGES

Although the prior art devices have served their purpose well, there are times when the operators of oncoming vehicles must know how persons seen in or along their vehicle's path intend to move or turn, in order to avoid injuring them.

Many injuries occur when persons undertaking activities in areas that they must share with motor vehicles move or turn without first communicating their intentions to oncoming motorists.

In these instances, the operator of an oncoming vehicle may not have sufficient time to stop or to change direction in order to avoid injuring these persons.

It is therefore the object of the present invention to provide wearable and variably communicative direction signaling means.

It is a further object of this invention to enable clear and intelligible communication between motorists and non-motorists.

It is another object of this invention to foster safety between motorists and non-motorists who must share the same roadways and highways.

It is also an object of this invention to promote courtesy between motorists and non-motorists.

Still another object of this invention is the prevention of death and injury by reducing the likelihood of collision.

Yet another object of this invention is the provision of means whereby users may readily comply with statutes requiring them to wear reflective clothing and/or obey the rules of the road.

New York State law requires in-line skaters to wear reflective clothing during the period hours of reduced visibility. The statute further states, "Traffic laws apply to persons riding bicycles or skating or gliding on in-line skates."

This wearable vehicular signaling system provides extended visibility means and controllably communicative direction signaling means, enabling a user to comply with this statute.

Users of this wearable vehicular signaling system would include, but not be limited to, pedestrians, runners, joggers, skaters, bicyclists, school patrol persons, traffic control officers, visually impaired persons, roadway and highway repair persons, persons on horseback, the visually impaired, children, the elderly. The operator of a motorcycle, a tractor, or a forklift could also find this wearable vehicular signaling system useful.

This wearable vehicular signaling system has obvious and specific advantages over the prior art, which provides extended visibility, but does not provide means for communication.

Further objects and advantages will become apparent from a consideration of the drawings and ensuing description.

BRIEF DESCRIPTION OF THE DRAWING FIGURES

This wearable vehicular signaling system is illustrated in the drawings, wherein.

Reference Numerals in Drawings

Figure 1:
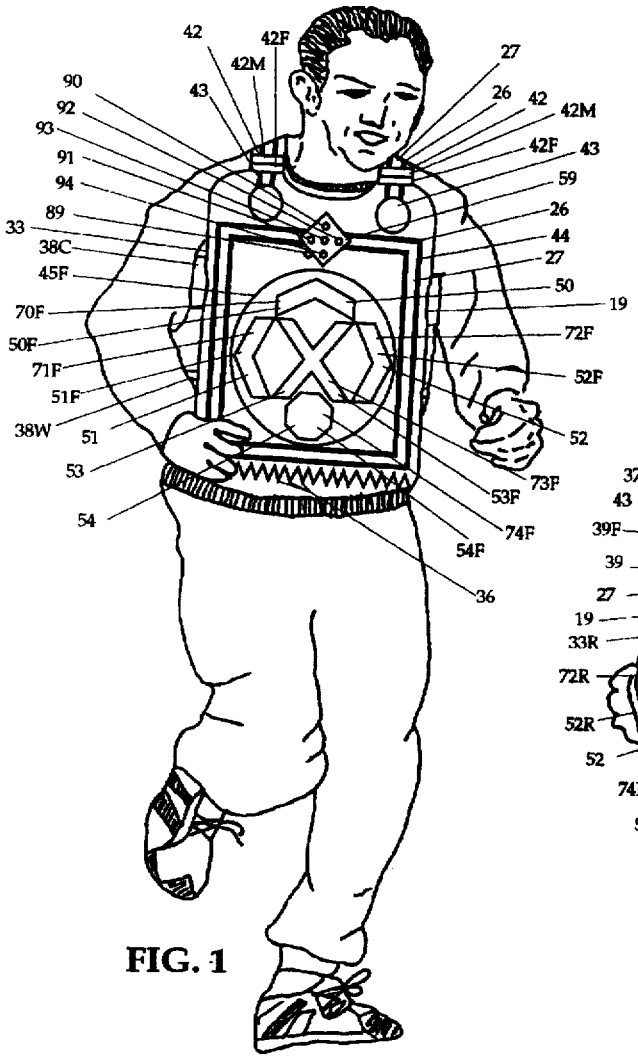
FIG. 1 is a front view of a person wearing a preferred embodiment.

| | | | |
|---|---|---|---|
| 19 | Preferred embodiment | 51 | Right turn signal |
| 20 | First alternative embodiment | 51F | Front right turn signal light subassembly |
| 21 | Second alternative embodiment | | |
| 22 | Third alternative embodiment | 51R | Rear right turn signal light subassembly |
| 23 | Fourth alternative embodiment | 52 | Left turn signal |
| 24 | Bright colored material | 52F | Front left turn signal light subassembly |
| 25 | Strong, flexible material | 52R | Rear left turn signal light subassembly |
| 26 | Dark colored material | 53 | Crossing signal |
| 27 | Reflective material | 53F | Front crossing signal light subassembly |
| 28 | Braided nylon | 53R | Rear crossing signal light subassembly |
| 29 | Firm but flexible material | 54 | Stopping signal |
| 30 | Elastic material | 54F | Front brake signal light subassembly |
| 33 | Preferred garment | 54R | Rear brake signal light subassembly |
| 34 | First alternative garment | 55F | Alternative front brake signal light subassembly |
| 35 | Second alternative garment | | |
| 33F | Preferred garment, front panel | 55R | Alternative rear brake signal light subassembly |
| 34F | First alternative garment, front panel | | |
| 35F | Second alternative garment, front panel | 59 | Switch housing subassembly |
| 33R | Preferred garment, rear panel | 60F | Housing of subassembly 50F |
| 34R | First alternative garment, rear panel | 60R | Housing of subassembly 50R |
| 3rR | Second alternative garment, rear panel | 61F | Housing of subassembly 51F |
| 36 | Triangular points | 61R | Housing of subassembly 51R |
| 37 | Shoulder straps | 62F | Housing of subassembly 52F |
| 38C | Chest level belt | 62R | Housing of subassembly 52R |
| 38W | Waist level belt | 63F | Housing of subassembly 53F |
| 39 | Pocket | 63R | Housing of subassembly 53R |
| 39F | Flap on pocket 39 | 64F | Housing of subassembly 54F |
| 41 | Mating hook-and-loop fasteners | 64R | Housing of subassembly 54R |
| 42 | Quick release buckles | 65F | Housing of subassembly 55F |
| 42M | Male parts of buckles 42 | 65R | Housing of subassembly 55R |
| 42F | Female parts buckles 42 | 66 | Electrical assembly |
| 43 | Reflectors | 67 | Circuit |
| 44 | Reflective bands | 68 | Circuit wires |

-continued

| Reference Numerals in Drawings | | | |
|---|---|---|---|
| 45F | Sheet of firm, flexible material | 69 | Lamps |
| 45R | Sheet of firm, flexible material | 70F | Lens of subassembly 50F |
| 48 | Line marking sectional view | 70R | Lens of subassembly 50R |
| 50 | Forward motion signal | 71F | Lens of subassembly 51F |
| 50F | Front forward motion signal light subassembly | 71R | Lens of subassembly 51R |
| 50R | Rearforward motion signal light subassembly | 72F | Lens of subassembly 52F |
| 73R | Lens of subassembly 53R | 72R | Lens of subassembly 52R |
| 74F | Lens of subassembly 54F | 73F | Lens of subassembly 53F |
| 74R | Lens of subassembly 54R | 104 | Tubular hole on mounting means 47 |
| 75F | Lens of subassembly 55F | 107 | Lining of vest-like garment 34 |
| 75R | Lens of subassembly 55R | 109 | Shiny, silver colored material |
| 76 | Batteries | 110 | Lamp socket |
| 77 | Actuated device | 112 | Lining of vest-like garment 35 |
| 78 | Battery compartment | 113 | Openings along edges of box 88 |
| 78C | Battery contacts | 114 | Edges of box 88 |
| 79 | Outer edges of garments 33, 34, 35 | 115 | Screw at base of switch housing subassembly |
| 86 | Line along bases of triangles 36 | 116 | Base of switch housing subassembly |
| 88 | Vest mount for switch housing subassembly | 117 | Handlebar mount |
| 89 | Main ON-OFF switch subassembly | 117H | Housing of handlebar mount |
| 90 | Switch for actuating signal 50 | 118 | Opening for receiving screw 115 |
| 91 | Switch for actuating signal 51 | 119 | Screw for securing mount 117 |
| 92 | Switch for actuating signal 52 | 120 | Flange on screw 119 |
| 93 | Switch for actuating signal 53 | 121 | Opening for receiving screw 119 |
| 94 | Switch for actuating signal 54 | 122 | Self-contained signal light subassembly |
| 100F | Rectangle of firm, flexible material | 123 | Battery compartment on subassembly 122 |
| 100R | Rectangle of firm, flexible material | 124 | ON-OFF switch on subassembly 122 |
| 102 | Lining of vest-like garment 33 | 125 | A switching means responsive to movements wearer |
| 103 | Coiled circuit wire | | |

SUMMARY

For many persons today, sports and recreational activities are crucial to their mental and physical well-being. Many people who undertake such activities in areas that they must share with vehicles wear bright-colored or reflective clothing, many wear or carry a light.

The prior art expedients work only to alert the operators of oncoming vehicles to the presence, position, and beating of the users of this art.

Yet, there are times when these users must also communicate their intention to (1) commence, continue, or resume forward motion, (2) to turn or bear to the right, (3) to turn or bear to the left, (4) to cross the roadway, or (5) to stop. For although the operator of a vehicle sees the prior art apparel or lights, accidents still occur.

For example, a motorist is driving down the road and sees a jogger on the side of the road. The motorist may think that it is safe to pass the jogger on the left, not realizing that the jogger also plans to turn or bear to the left and the jogger may not check for oncoming vehicles before turning. This unanticipated change of direction may not give the motorist sufficient time to stop or turn when the jogger suddenly steps out in this motorist's path.

This wearable vehicular signaling system increases the safety of anyone who undertakes activities in areas they must share with vehicles. The operators of oncoming vehicles would not only be able see the user of this invention, but would also know what the user planned to do.

This information would make things safer not only for the user, but also for the person operating the vehicle. For the user, this invention could greatly reduce the risk of collision. In addition, the person operating the vehicle would benefit from not having to brake suddenly and risk losing control of his or her vehicle in order to avoid striking someone.

Toward the end of facilitating safety communication, this wearable vehicular signaling system is provided with visually communicative direction signaling means. This direction signaling means is disposed, arranged, and controllable so as to indicate, when actuated, the wearer's intention either to (1) commence, continue, or resume forward motion, (2) turn or bear to the right, (3) turn or bear to the left, (4) cross the roadway, or (5) stop.

While many embodiments are possible, this wearable vehicular signaling system requires:

(A) direction signaling means and (B) means for wearing the direction signaling means on or about the body.

Controlled operation of the directional signaling means further requires:

(C) means for powering the direction signaling means;

(D) means for actuating the direction signaling means; and (E) means for controlling the direction signaling means.

Accordingly, this wearable vehicular signaling system may reside in a vest-like garment, a harness, a jacket, a coat, pants, or any other garment.

Direction signaling means could be provided by flashable lights.

Power means could be provided by a battery that is rechargeable or replaceable.

Means for actuating the direction signaling means may be provided by a main ON-OFF switch.

Means for controlling the direction signaling means may be provided by a switch or switches linked to a main ON-OFF switch.

All of these switches may reside in a switch housing subassembly. This switch housing subassembly may be mounted removably upon the wearable vehicular signaling system. This provision could permit said subassembly to be hand-held or attachable to the frame of a bicycle.

Alternatively, this wearable vehicular signaling system may be manufactured as a kit and provided with means for securement to a garment chosen by the user.

This wearable vehicular signaling system is used by turning ON the device and securing it upon one's person. The user then operates the wearable vehicular signaling system by closing the switch that controls the actuation of the signal he or she needs to communicate.

The operators of oncoming vehicles see the actuated signal, are alerted to the user's intentions, and, thus informed, are able to avoid colliding with the user.

DESCRIPTION OF THE PREFERRED EMBODIMENT—FIGS. 1–5

Figure 2:
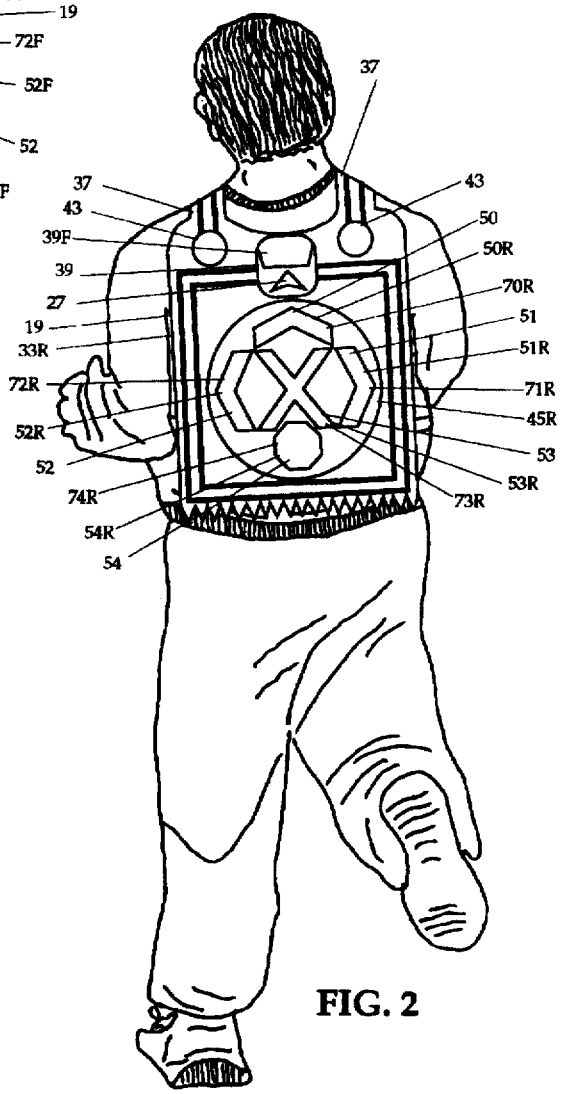
FIG. 2 is a back view of a person wearing a preferred embodiment.

A preferred embodiment of this wearable vehicular signaling system 19 is shown being worn by a person, so that he or she can communicate his or her intention to (1) commence, continue, or resume forward motion, (2) turn or bear to the right, (3) turn or bear to the left, (4) cross the roadway, or (5) stop in a manner that is readily observed by an operator of an oncoming vehicle, not shown, FIGS. 1–2.

Preferred embodiment 19 is provided with five signals 50, 51, 52, 53 and 54. Signal 50 could communicate intent to commence, continue, or resume forward motion. Signal 51 could communicate intent to turn or bear to the right. Signal 52 could communicate intent to turn or bear to the left. Signal 53 could communicate intent to cross the roadway or highway. And signal 54 could communicate intent to stop.

Figure 3:
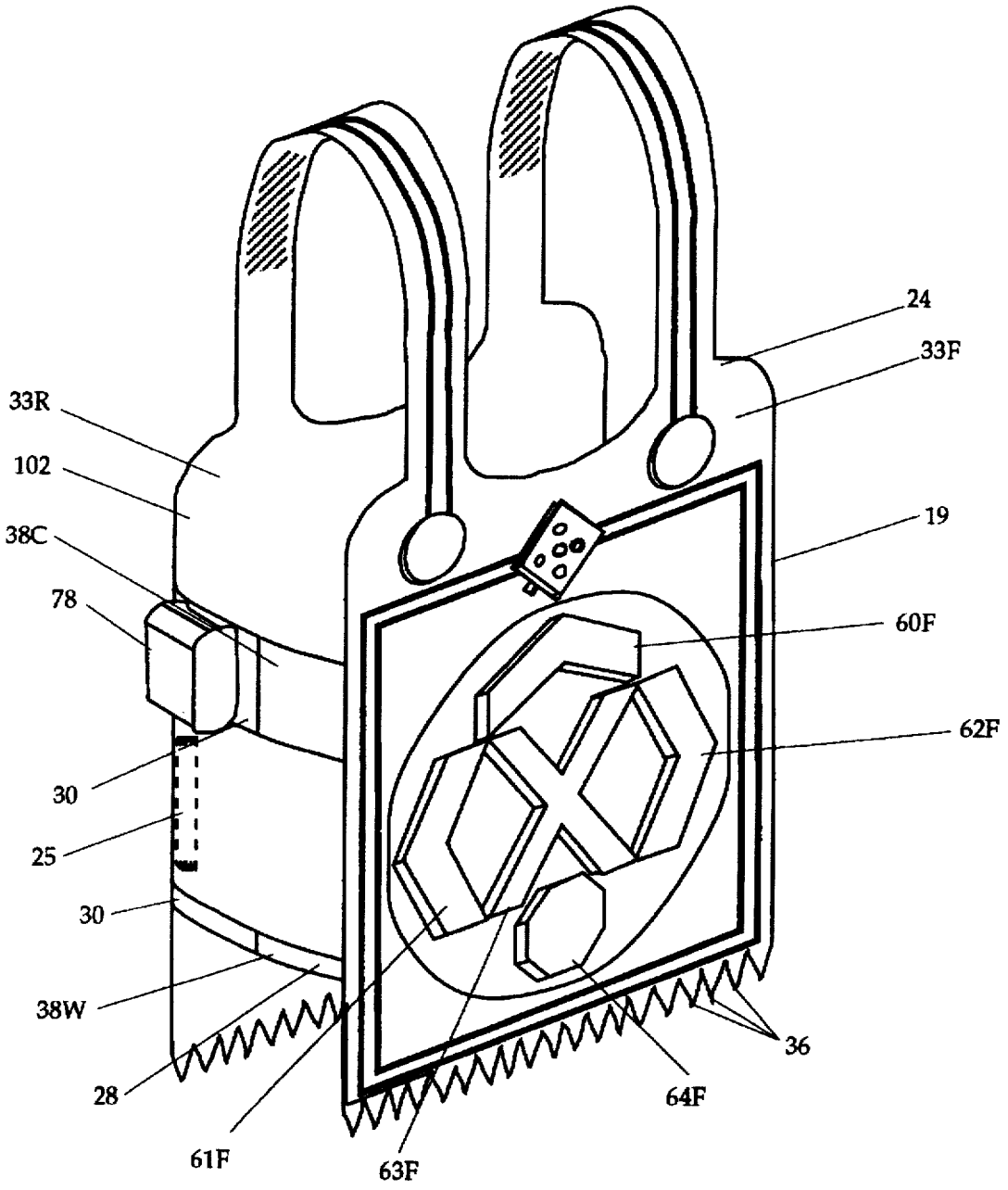
FIG. 3 is a front perspective view of the wearable vehicular signaling system, with portions removed to illustrate the location of the circuitry and battery.

The Garment—FIGS. 1–3—Preferred embodiment 19 may reside in a vest-like garment 33. Vest-like garment 33 could be made from a durable, water resistant, bright-colored material 24.

Vest-like garment 33 may be comprised of a front panel 33F and a back panel 33B. Front and back panels 33F and 33B could be joined by shoulder straps 37, a chest-level belt 38C, and a waist-level belt 38W. A liner 102 could be disposed generally inside vest-like garment 33. Said liner would form an inner layer of garment 33.

Garment 33 could be reinforced with a very strong, durable but flexible material 25. A strip of material 25 could be sewn within the folded over edges of bright colored material 24, except at the bottom edges of vest-like garment 33.

The bottom edges of vest-like garment 33 may be cut into triangular points 36. The edges of triangular points 36 may be folded over and sewn to prevent fraying.

On front panel 33F and back panel 33R, a strip of very strong material 25 can be sewn along the bases of triangles 36.

Reflective bands 44 may be provided on vest-like garment 33. Bands 44 could be made of reflective or luminescent material 27 sewn to wider bands of an often darker material 26. These reflective bands 44 may be arranged to form a rectangular figure as seen in FIGS. 1–3.

Shoulder straps 37 and belts 38C and 38W could be sewn to back panel 33R. Quick release buckle mechanisms 42 having respective male and female formed interlocking snap components could be used to secure shoulder straps 37 and belts 38C and 38W to front panel 33F.

Female components 42F of quick release buckle mechanisms 42 may be secured to front panel 33F, near outer edges 79. Male components 42M of buckles 42 could be fitted to the forward ends of straps 37 and belts 38C and 38W preferably in a manner that makes these straps and belts substantially adjustable in length. This provision is made to permit vest-like garment 33 to fit users of various physiques, and to allow this wearable vehicular signaling system to be worn while the user is wearing a backpack or similar item.

Belt 38C may be made from bright material 25. Belt 38W could be made from a braided nylon material 28. Belts 38C or 38W may be partly composed of an elastic material 30.

Reflectors and Pocket—FIGS. 1–3—A plurality of reflectors 43 could be provided on the front and/or back of this wearable vehicular signaling system. A pocket 39 may be provided in an upper area of back panel 33R. Mating hook-and-loop fasteners 41 could be used to secure flap 39F of this pocket 39 in the closed position.

Without further modification, vest-like garment 33 is useful only as extended visibility means.

However, the operators of oncoming vehicles frequently need to know how persons whom they see on or along their vehicle's path will move or turn, in order to avoid accidentally injuring or killing these persons.

Therefore, during the manufacture of vest-like garment 33 an electrical assembly 66 is added to enable the vest-like garment to become a wearable vehicular signaling system 19.

Direction Signaling Means—FIGS. 1–4A—Direction signaling means may be provided by one or more flashable direction signaling light subassemblies.

Preferred embodiment 19 is provided both in front and in back with five directional signals 50, 51, 52, 53, and 54.

These five directional signals 50, 51, 52, 53, and 54 could reside in direction signaling light subassemblies 50F and 50R, 51F and 51R, 52F and 52R, 53F and 53R, and 54F, and 54R.

It may be advantageous if a user of this wearable vehicular signaling system could communicate with those both behind and ahead of him or her.

Therefore subassemblies 50F, 51F, 52F, 53F, 54F could be located on the front of signaling system 19 and subassemblies and 50R, 51R, 52R, 53R, 54R on the backside thereof.

Each signal light subassembly 50F, 50R, 51F, 51R, 52F, 52R, 53F, 53R, 54F, and 54R could be comprised of a signal light housing 60F, 60R, 61F, 61R, 62F, 62R, 63F, 63F, 64F, or 64R; a lamp socket 110; circuit wires 68; an incandescent lamp 69; a lens 70F, 70R, 71F, 71R, 72F, 72R, 73F, 73F, 74F, or 74R; an arrangement of clips 56; and a gasket 80F, 80R, 81F, 81R, 82F, 82R, 83F, 83F, 84F, or 84R made of a rubber-like material 32.

The signal light housings could be coated inside with a shiny, silver colored material 109. Clips 56 could hold the lenses securely upon the housings when this wearable vehicular signaling system is in use, yet permit said lenses to be removed when the lamps need to be changed. The gaskets could be provided as a seal between each housing and lens.

There may be no limit to the shapes given to subassemblies 50F, 50R, 51F, 51R, 52F, 52R, 53F, 53R, 54F, and 54R. Indeed, a variety of shapes may be held equally effective in communicating the information signified by signals 50, 51, 52, 53 and 54. Some or all of the subassemblies may be shaped in relationship to their function.

For instance, since subassemblies 50F, 50R, 51F, 51R, 52F, and 52R, communicate motion or a change in motion in or toward a particular direction, these subassemblies could be arrowhead-shaped and oriented on the garment to point in a suggestive manner. Subassemblies 53F and 53R could be X-shaped. This shape imitates the "X" substituted for the word "Cross" as in "Railroad X-ing." Subassemblies 54F and 54R could be octagonal, in imitation of a stop sign.

Similarly, lens 70F, 70R, 71F, 71R, 72F, 72R, 73F, 73F, 74F, and 74R may be one or several colors. Colors may be chosen arbitrarily or could be selected for their attractiveness. Colors may also be used for their ability to aid in producing signals that are move visible or more intelligible.

Subassemblies 50F and 50R, when actuated, indicate that the user of signaling system 19 intends to commence, continue, or resume forward motion. Lenses 70F and 70R could be tinted green, associating the signal with the "Go" signified by the green traffic signal.

Subassemblies 51F and 51R, when actuated, indicate that the wearer of signaling system 19 intends to turn or bear to his or her right. Subassemblies 52F and 52R, when actuated, indicate that the wearer of signaling system 19 intends to turn or bear to his or her left. Lenses 71F, 71R, 72F, and 72R could be tinted amber, as are many vehicles' turn signals.

Subassemblies 53F and 53R, when actuated, indicate that the wearer of signaling system 19 intends to cross the roadway or highway. Lenses 73F and 73R could be tinted blue.

Subassemblies 54F and 54R, when actuated, indicate that the wearer of signaling system 19 intends to stop. Lenses 74F and 74R could be tinted red, as are most vehicles' brake lights.

Arrangement of the Direction Signaling Light Subassemblies—FIGS. 1–2—On front panel 33F subassemblies 51F and 52F could be located on either side of the center line of vest-like garment 33. Subassembly 51F could be arranged to point toward the wearer's right. Subassembly 52F could be arranged to point toward the wearer's left. Subassembly 53F may be located in a central area of panel 33F, between subassemblies 51F and 52F. Subassembly 50F could be located above subassembly 53F and arranged to point upward. Subassembly 54F may be located below subassembly 53F.

The arrangement of subassemblies 50F, 51F, 52F, 53F, and 54F on front panel 33F could mirror the arrangement of subassemblies 50R, 51R, 52R, 53R, and 54R on back panel 33R.

Therefore, on back panel 33R, subassemblies 51R and 52R could be located on either side of the center line of vest-like garment 33. Subassembly 51R could be arranged to point toward the wearer's right. Subassembly 52R could be arranged to point toward the wearer's left. Subassembly 53R may be located in a central area of panel 33R, between subassemblies 51R and 52R. Subassembly 50R could be located above subassembly 53R and arranged to point upward. Subassembly 54R may be located below subassembly 53R.

When any one of the five directional signals 50, 51, 52, 53 or 54 is actuated, the corresponding, respective pair of direction signaling light subassemblies 50F and 50R, 51F and 51R, 52F and 52R, 53F and 53R, or 54F and 54R would flash.

This flashing signal would communicate the wearer's intentions.

This arrangement in front-back pairs permits observation of the signal from the front and rear of the wearer. Observers approaching the user from in front and from behind would know if the user intends to either (1) commence, continue, or resume forward motion, (2) turn or bear to the right, (3) turn or bear to the left, (4) cross the roadway, or (5) stop. The significance and intelligibility of signals are reinforced by their shape and color.

Figure 4:
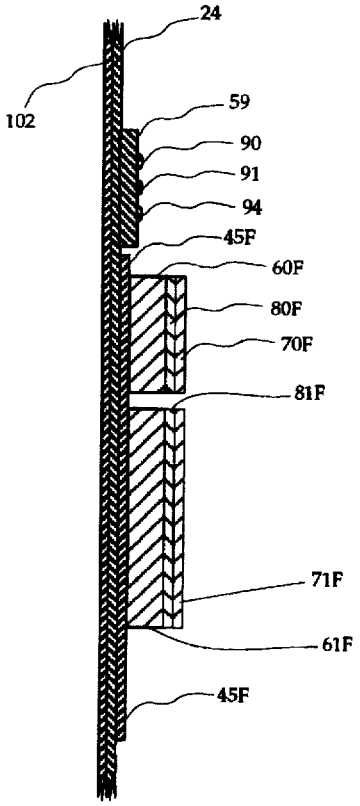
FIG. 4 is a partial sectional view of the front panel of the preferred embodiment of the wearable vehicular signaling system taken along the lines 48—48 to illustrate the assembly and mounting of the direction signaling light subassemblies and the switch housing subassembly.
Figure 4A:
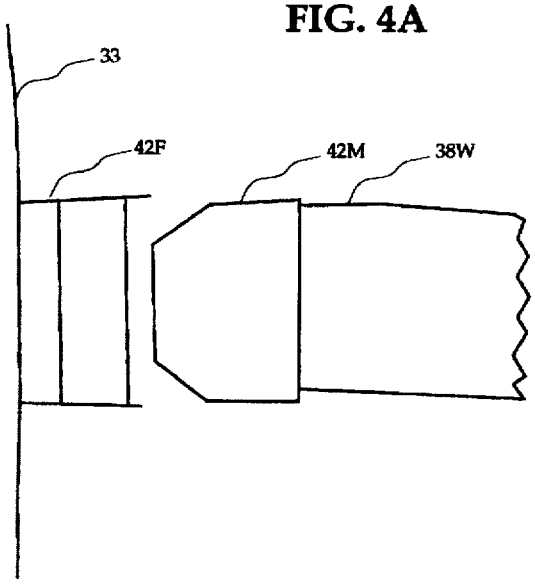
FIG. 4A is a partial side view illustrating the mounting of the buckle mechanisms.

Direction Signaling Light Subassembly Securement Means—FIG. 4—There is a need to hold subassemblies 50F, 51F, 52F, 53F, and 54F and subassemblies 50R, 51R, 52R, 53R, and 54R securely in place while signaling system 19 is in use. Sheets 45F and 45R could be used to hold the subassemblies securely in place. These sheets are preferably made of a firm but flexible material 29.

Housings 60F, 61F, 62F, 63F, 63F, 64F may be secured to sheet 45F. Housings 60R, 61R, 62R, 63R, and 64R may be secured to sheet 45R.

Sheet 45F could be secured to the front panel of the vest-like garment; sheets 45R could be secured to the back panes of the vest-like garment.

The direction signaling light subassembly housings could be sewn to the sheets, and the sheets may be sew to the vest-like garment. Alternatively, adhesive means, mating hook-and-loop fasteners, or other means of securement could be employed.

If stitching is used as securement means, the housings or other elements may be provided with openings along their outer edges.

Figure 5:
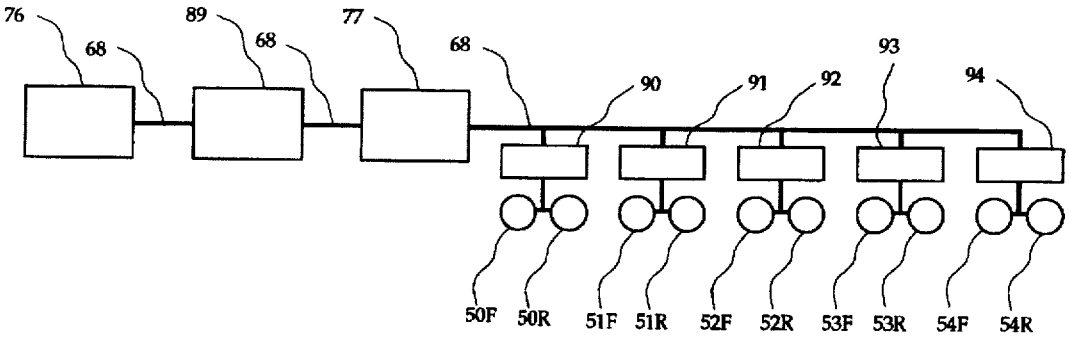
FIG. 5 is a block diagram of the circuitry, switches and batteries.

Means for Power, Actuation, and Control—FIG. 5—Power means could be provided by four replaceable or rechargeable AA batteries 76. Alternatively, a six volt battery or other power means may be used. This battery or batteries may reside removably in a battery compartment.

Batteries 76 could reside removably in a battery compartment 78. Compartment 78 could be secured to belt 38C, close to back panel 33R. Alternatively, compartment 78 could be located elsewhere on vest-like garment 33 and secured thereto.

A circuit 67 could provide an oscillating current of six volts direct current which flash lamps 69, illuminating the directional signals. Lamps 69 could be 250 MA lamps. Both the lights and batteries are available over the counter, when their replacements are necessary.

Circuit wires 68 can be positioned, where needed, in the spaces between bright colored material 24 and sheets 45F and 45R, in the spaces between bright material 24 and the liner, as well as in vertical spaces and the horizontal spaces between reflective bands 44 and material 24.

Circuit wires may be led up the back of the vest-like garment and passed within the shoulder straps to the front panel of the vest-like garment.

Where circuit wires are made to pass through an area of the vest-like garment that is adjustable, such as the shoulder straps, these wires could be coiled in order to allow them to be extended to variable lengths without breaking.

Means for actuation could be provided by a main ON-OFF switch subassembly 89. Means for controlling the actuation of signals 50, 51, 52, 53 and 54 could be provided, respectively, by switch subassemblies 90, 91,92, 93, and 94.

Current from batteries 76 could be directed to main ON-OFF switch subassembly 89. When switch subassembly 89 is closed, this current could be made to enter a flashing device 77. From flashing device 77 this current would be directed to switch subassemblies 90, 91,92, 93, and 94.

Switch subassemblies 89, 90, 91,92, 93, and 94 could reside in a switch housing subassembly 59. This switch housing subassembly 59 may be removably secured to the vest-like garment.

Switch housing subassembly 59 may be hand-held. Switch housing subassembly 59 may also be provided with means whereby it could be mounted on the handlebars of a bicycle.

With this switch housing subassembly 59 the user can "TURN ON" wearable vehicular signaling system 19 and further control the actuation of directional signals 50, 51, 52, 53 and 54.

Main ON-OFF switch subassembly 89 could be of the tab type, requiring a very specific finger manipulation to secure it in the ON position.

Switch subassemblies 90, 91,92, 93, and 94 could be of the push button type. These push-button switch subassemblies 90, 91, 92, 93, and 94 are closed by depressing and so could be raised only slightly above the front surface of the switch housing subassembly 59. This arrangement could prevent the accidental actuation of the lamps.

Furthermore, it may be advantageous if switch housing subassembly 59 is constructed such that the closing of one push-button switch releases, in turn, any already closed switch. Such a construction could prevent two or more signals from being actuated simultaneously.

With main ON-OFF switch subassembly 89 in the ON position, any one of the five switch subassemblies 90, 91,92, 93, and 94 on the switch housing subassembly 59, when closed, cause the illumination of the corresponding, respective pair of direction signaling light subassemblies 50F and 50R, 51F and 51R, 52F and 52R, 53F and 53R, or 54F and 54R.

Switch 90, when closed, actuates forward motion direction signaling light subassemblies 50F and 50R when the main ON-OFF is also closed. Switch 91, when closed, actuates right turn direction signaling light subassemblies 51F and 51R when the main ON-OFF is also closed. Switch 92, when closed, actuates left turn direction signaling light subassemblies 52F and 52R when the main ON-OFF is also closed. Switch 93, when closed, actuates "crossing" direction signaling light subassemblies 53F and 53R when the main ON-OFF is also closed. And switch subassembly 94, when closed, actuates stopping direction signaling light subassemblies 54F and 54R when the main ON-OFF is also closed.

For mnemonic reasons, the arrangement of switches 90, 91,92, 93, and 94 on switch subassembly housing subassembly 59 could mimic the arrangement of the direction signaling light subassemblies.

Thus, switch 90 could be located at the top of switch housing subassembly 59, on the centerline thereof. Switch 94 could be located at the bottom of switch housing subassembly 59, on the centerline thereof. Switch 93 could be located at the center of switch housing subassembly 59. Switch subassembly 91 could be located on the right side of switch housing subassembly 59, on the horizontal centerline thereof. And switch subassembly 92 could be located on the left side of switch housing subassembly 59, on the horizontal centerline thereof.

This mimetic arrangement of the switch subassemblies could minimize the incidence of a user actuating an unintended signal.

If mounted upon the vest-like garment, switch housing subassembly 59 could be located in a central, high chest area of the garment. Alternatively, switch housing subassembly 59 could be located in some other conveniently accessible area.

Stitching, adhesives, or other securement expedients may be used as means for securing the switch housing subassembly upon the vest-like garment.

OPERATION OF THE PREFERRED EMBODIMENT

The user moves the main ON-OFF switch into the ON position.

The user then places the wearable vehicular signaling system upon his or her person and adjusts the length of the shoulder straps and belts through the buckle mechanisms so that the vest-like garment fits snugly about his or her person.

With the wearable vehicular signaling system ON, the user can then controllably actuate any one of the five flashable directional signals by way of the switch housing subassembly. The user simply depresses the switch that corresponds to the signal the user wishes to communicate.

Before the user of this wearable vehicular signaling system 19 commences forward motion, he or she would actuate the forward motion signal 50. He or she does so by depressing switch 90.

In using this wearable vehicular signaling system 19, a user would give his or her signal in a timely fashion, allowing the operators of oncoming vehicles sufficient time to see the signal and take action to avoid accidentally injuring or killing the user.

DESCRIPTION AND OPERATION OF AN ALTERNATIVE EMBODIMENT—FIGS. 6–8

Figure 6:
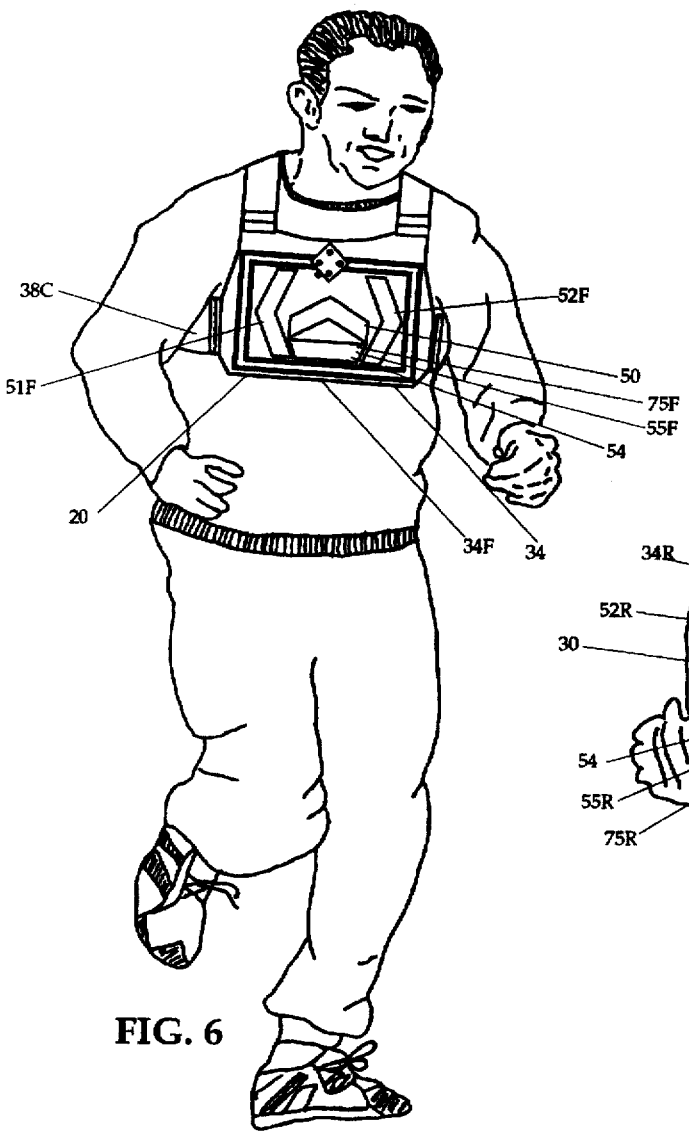
FIG. 6 is a front view of a person wearing an alternative embodiment.
Figure 7:
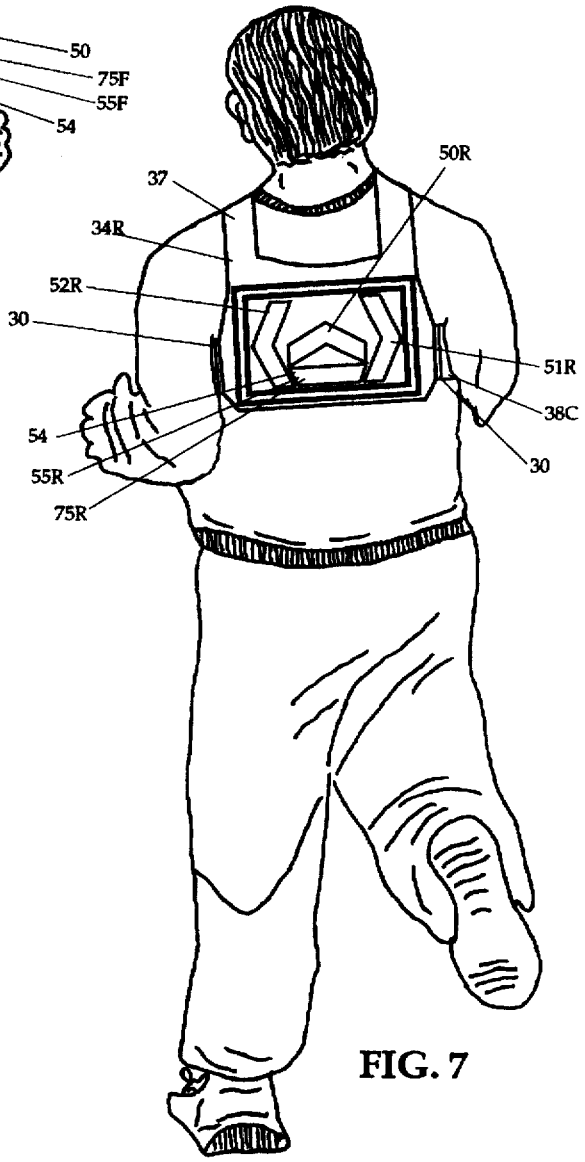
FIG. 7 is a back view of a person wearing an alternative embodiment.
Figure 8:
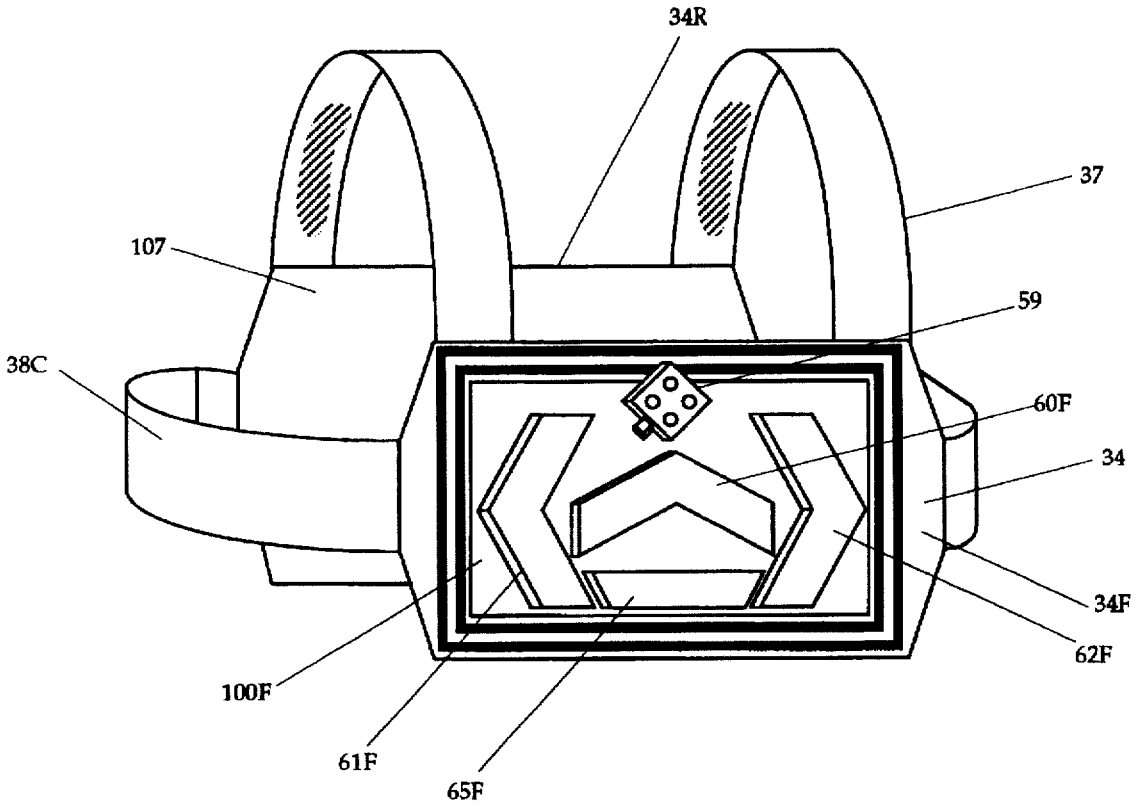
FIG. 8 is a front perspective view of an alternative embodiment.

FIGS. 6–8 show an alternative embodiment 20 of a wearable vehicular signaling system being worn by a person, so that he or she can communicate his or her intentions to an operator of an oncoming vehicle, not shown.

A description of those elements of design, composition, construction, and operation that differ from the preferred embodiment is as follows.

This alternative embodiment 20 of wearable vehicular signaling system 19 enables users to communicate their intention (1) commence, continue, or resume forward motion, (2) turn or bear to the right, (3) turn or bear to the left, or (4) stop. Embodiment 20 is provided with direction signaling light subassemblies 50F and 50R, 51F and 51R, 52F and 52R, and 55F, and 55R.

In embodiment 20 the arrangement of subassemblies 50F, 50R, 51F, 51R, 52F, 52R, 55F, and 55R requires less space, enabling embodiment 20 to reside in a smaller vest-like garment 34. This alternative vest-like garment 34 could be provided with shoulder straps 37 and belt 38W.

Brake signal 54 could be comprised of two trapezoidal subassemblies 55F and 55R, instead of octagonal subassemblies 54F and 54R. Lenses 75F and 75R of signal 55F and 55R of subassemblies 55F and 55R could be tinted red.

Embodiment 20 could be provided with switch subassemblies 89, 90, 91, 92, and 94. Switch 94 could control the actuation of light subassemblies 55F and 55R.

Because of its generally smaller dimensions, embodiment 20 could be easier for a user to travel with embodiment 20.

Embodiment 20 is operated in the same manner as embodiment 19. Because crossing signal 53 is eliminated, a user of embodiment 20 could use signal 50 to communicate his or her intention to go forward across the roadway or highway.

DESCRIPTION AND OPERATION OF A SECOND ALTERNATIVE EMBODIMENT—FIG. 9

Figure 9:
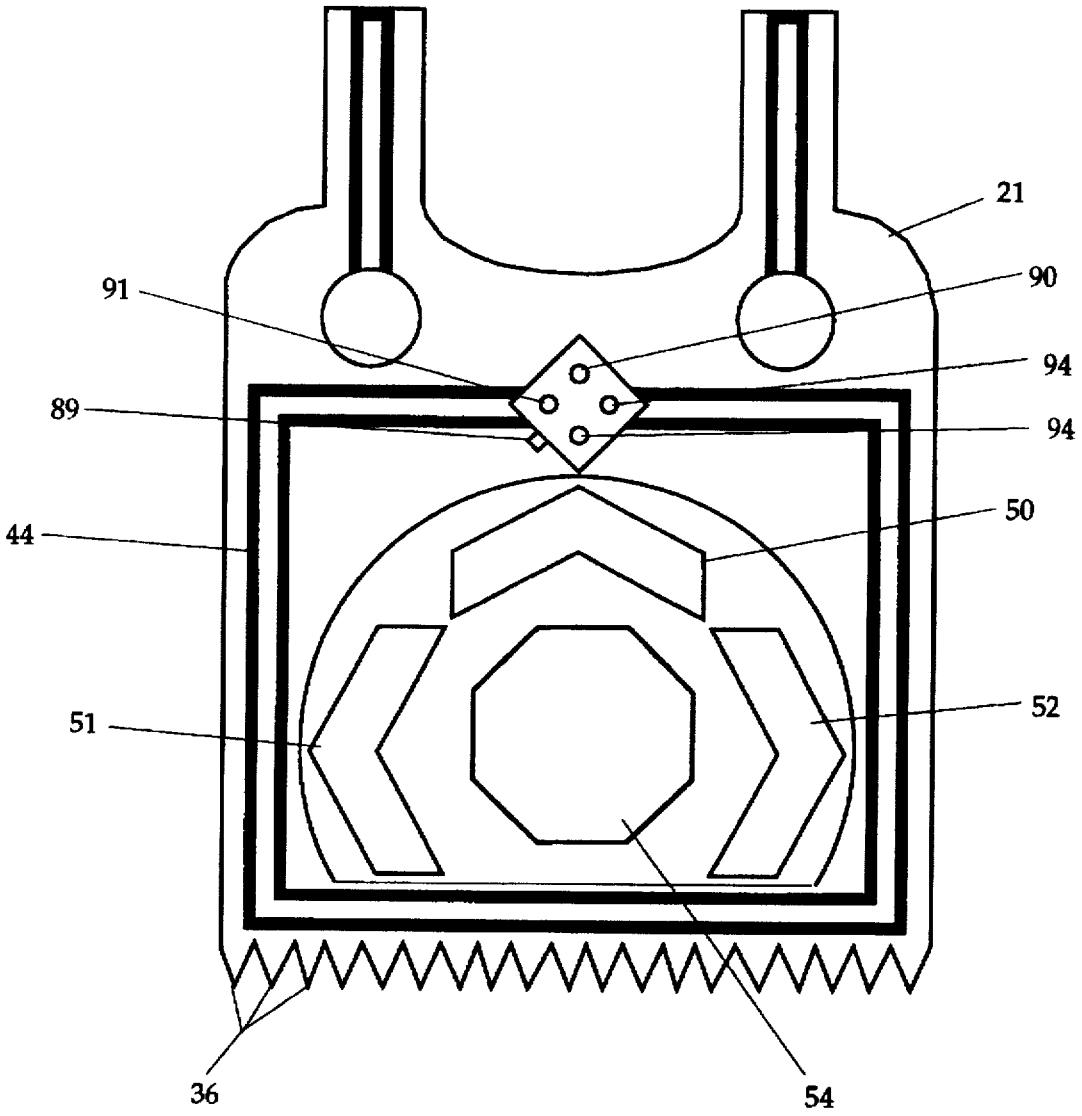
FIG. 9 is a front view of a second alternative embodiment.

FIG. 9 shows a second alternative embodiment 21 of a wearable vehicular signaling system.

Alternative embodiment 21 is also provided with four signals 50, 51, 52, and 54. Embodiment 21 is provided with subassemblies 50F and 50R, 51F and 51R, 52F and 52R, and 54F and 54R.

Embodiment 21 could be made to reside in another alternative vest-like garment-like garment 35. Vest-like garment-like garment 35 would be a shortened version of vest-like garment 33.

In this second alternative embodiment 21, crossing signal 53, is also provided. Thus, subassemblies 53F and 53R, are eliminated. Subassemblies 54F and 54R could be moved up into a central area of vest-like garment 35.

Alternative vest-like garment 35 may also be provided with a pocket on the backside thereof, as is vest-like garment 33.

DESCRIPTION AND OPERATION OF A THIRD ALTERNATIVE EMBODIMENT—FIG. 10

Figure 10:
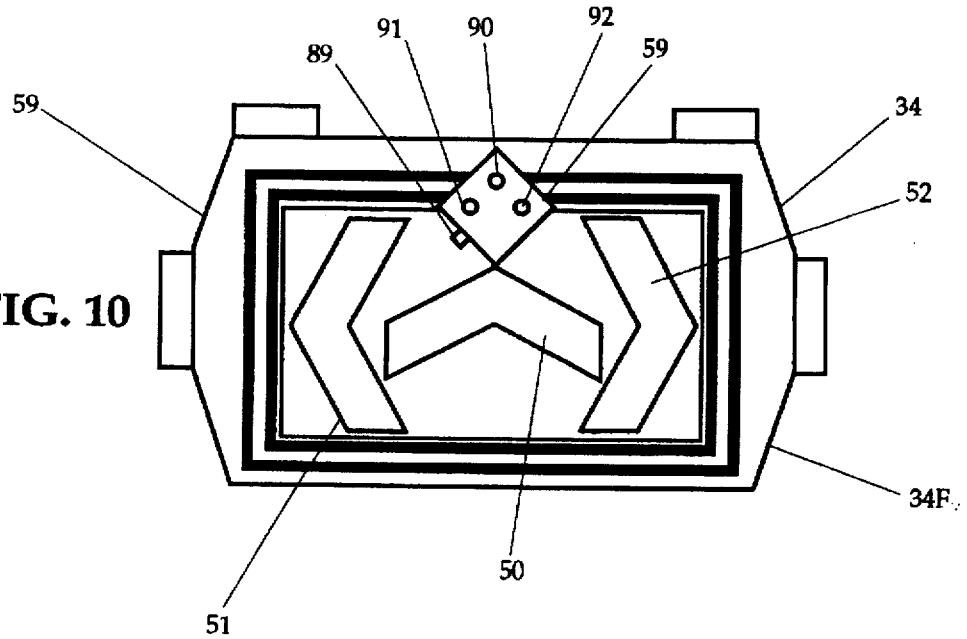
FIG. 10 is a front view of a third alternative embodiment.

FIG. 10 shows a third embodiment 22, which resides in vest-like garment 34 and is provided with subassemblies 51F and 51R, 52F and 52R, and either 50F and 50R or 55F and 55R.

These direction signaling light subassemblies would allow a user to communicate his or her intention to turn or bear to the right, turn or bear to the left, and to either commence, continue, or resume forward motion or stop-depending on whether subassemblies 50F and 50R or 55F and 55R are provided.

Embodiment 22 could be provided with switches 89, 91, 92, and 90 or 94.

DESCRIPTION AND OPERATION OF A FOURTH ALTERNATIVE EMBODIMENT—FIG. 11

Figure 11:
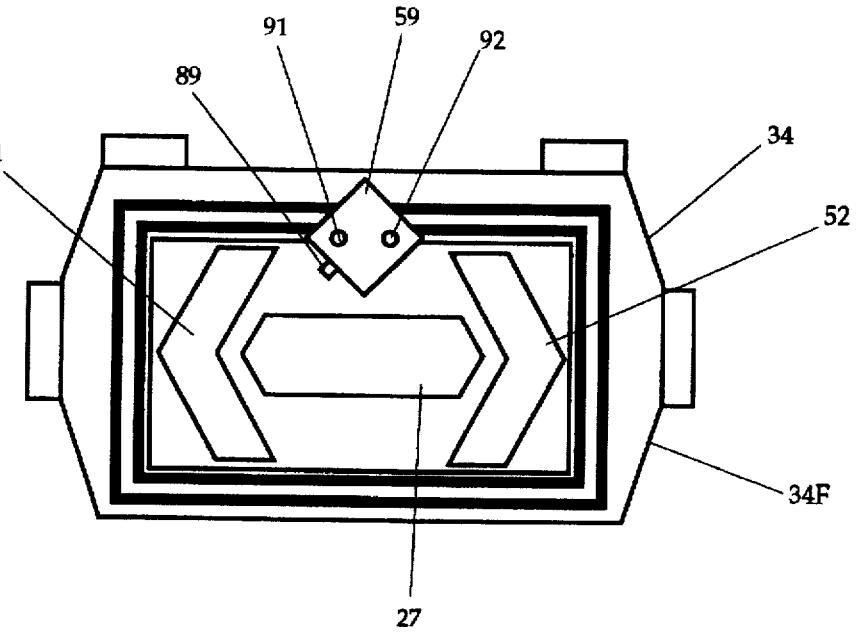
FIG. 11 is a front view of a fourth alternative embodiment.

Illustrated in FIG. 11, a fourth alternative embodiment of this wearable vehicular signaling system 23 also resides in alternative vest-like garment 34.

Provided with light subassemblies 50F, 50R, 51F, and 51R, this embodiment 23 allows the user to communicate to the operators of oncoming vehicles that he or she intends to (1) turn or bear to the right, or (2) turn or bear to the left.

Embodiment 23 could be provided with switch subassemblies 89, 90, 91.

ALTERNATIVE SECUREMENT MEANS FOR SWITCH HOUSING SUBASSEMBLY—FIGS. 12–13

If a user of this wearable vehicular signaling system is riding a bicycle, the necessity of removing one hand from bicycle's handlebars in order to reach the switch housing subassembly could prove inconvenient. Thus, it could be advantageous if switch housing subassembly 59 could be removed from the vest-like garment and secured to the frame of a bicycle.

Figure 12:
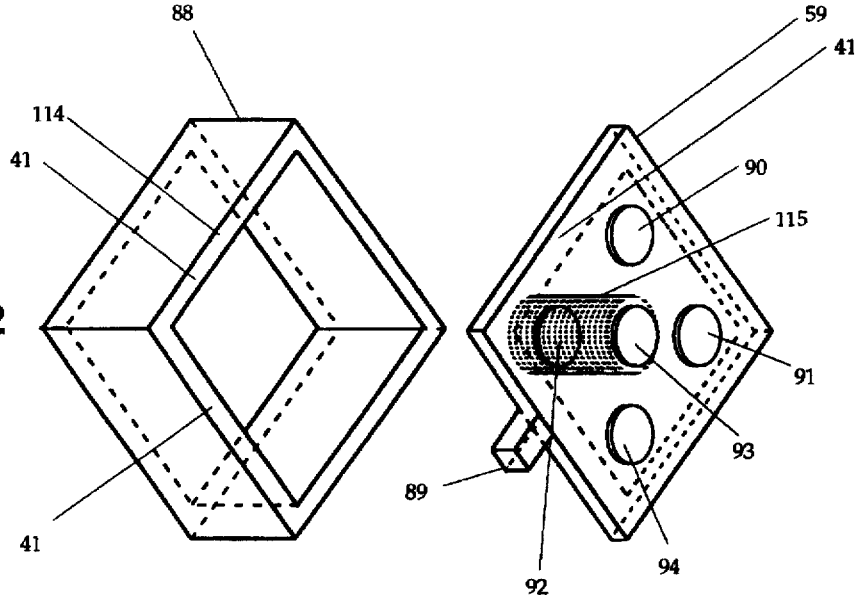
FIG. 12 is a side perspective view of means for removably mounting the switch housing subassembly upon the vest-like garment.
Figure 13:
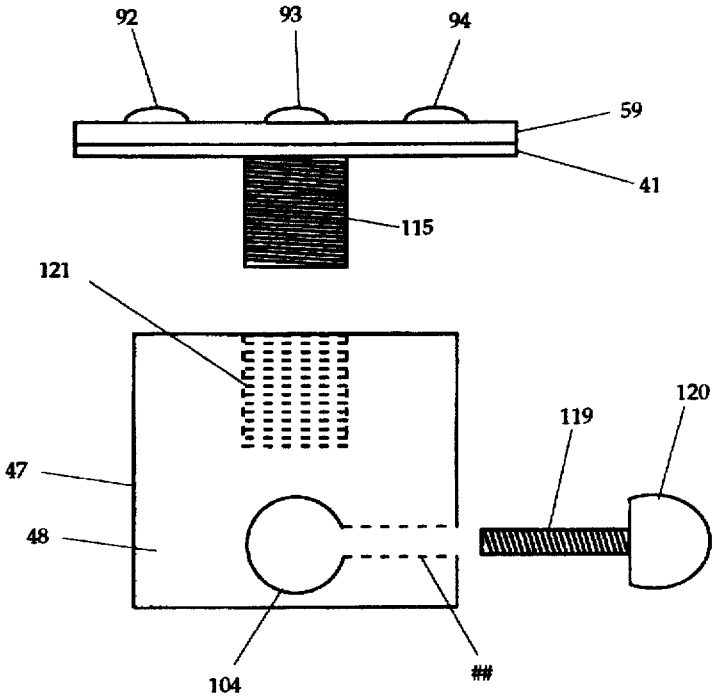
FIG. 13 is a side view of a means for securing the switch housing subassembly on the handle bars of a bicycle.

FIGS. 12–13 illustrate a mounting means useful for securing the switch housing subassembly to the handle bars of a bicycle.

So that the switch housing subassembly may be removed from the vest-like garment and fixed to the handlebars of a bicycle several elements, including a handle bar mount 117, are introduced.

A screw means 115 could be provided on the base of the switch housing subassembly. This screw could be used to secure the switch housing subassembly to mount 117.

A box-shaped mounting means 88 could be provided and secured to the front of the vest-like garment, in a high, central chest location.

Box 88 may be provided with hook portions of mating hook-and-loop fasteners 41, fixed along edges 114 to which the switch housing subassembly would be secured. The switch housing subassembly could be provided with loop portions of mating hook-and-loop fasteners 41.

External circuit wires 103 leading from an opening in the vest-like garment to the switch housing subassembly could be coiled. This coiled form would enable wires 103 to be pulled variable distances from the vest-like garment without becoming tangled or breaking.

When the user prefers, the switch housing subassembly may reside on the vest-like garment. The switch housing subassembly would be secured to box 88 by means of the mating hook-and-loop fasteners 41. Screw 115 and coiled circuit wires 103 could reside inside box 88.

Mounting means 117 could be comprised, in part, of a housing 117H provided with a threaded opening 118 for receiving screw 115. Housing 117H could also be provided with a tubular opening 104 of diameter suitable for readily fitting about the handlebars of a bicycle.

A screw device 119 could be provided for tightly securing mount 117 tightly upon the handlebars of a bicycle. Thus, housing 48 could further be provided with a threaded opening 121 for receiving screw 119. Threaded opening 121 could be located in housing perpendicular to tubular opening 104 and interrupting that opening on one side.

Screw 119 could be provided with a flange 120 in order to permit this screw to be turned without the need for additional tools.

When deemed necessary, the switch housing subassembly could be removed from mount 88. Mount 117 could be screwed to switch housing subassembly. Tubular opening 104 could be slid over the handlebars of a bicycle to locate the switch housing subassembly in a convenient position. And screw 119 could be turned until mount 117 is secured in the desired position.

Alternatively, the switch housing subassembly could be hand-held and a strap means may used to secure said switch housing subassembly to the hand or arm of a user.

One skilled in the art could devise other means for mounting the switch housing subassembly removably upon the vest-like garment or for securing the same to the frame of a bicycle.

Figure 14:
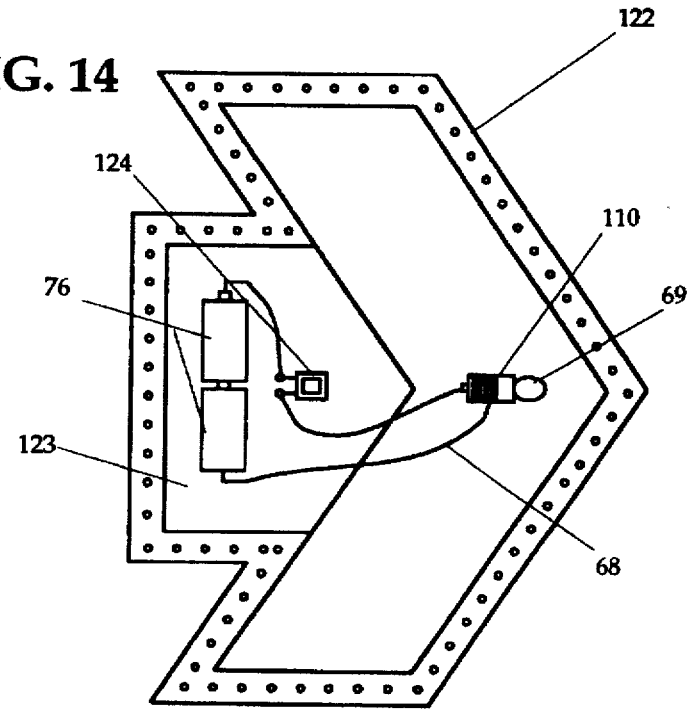
FIG. 14 is a front view of a wearable vehicular signaling system suitable for inclusion in a kit.

DESCRIPTION AND OPERATION OF A KIT FOR CREATING A WEARABLE VEHICULAR SIGNALING SYSTEM—FIG. 14

A kit for creating a wearable vehicular signaling system could include:

(A) some or all of the direction signaling light subassemblies 50F, 50R, 51F, 51R, 52F, 52R, 53F, 53R, 54F, 54R, 55F, and 55R;

(B) switch subassembly housing 59H, containing some or all of the switch subassemblies 89, 90, 91,92, 93, and 94;

(C) battery compartment 78;

(D) reflective bands 44 provided with a strong adhesive backing so that these bands could be used to conceal circuit wires;

(E) circuit wires 68, other elements described in this specification; and (F) instructions for the assembly and use of the kit.

A kit could also include a garment or leave selection and provision of a garment to the user.

Alternatively, such a kit could comprise a unit in which is combined a direction signaling light subassembly, a battery compartment, and actuation means.

FIG. 14 shows such a self-contained signal light subassembly 122 which is provided with a battery compartment 123 and a main ON-OFF switch 124.

This combination of the direction signaling means, the power means, and the actuation and control means in a single structure allows this wearable vehicular signaling system to be manufactured in a unit wherein one or more of these units may be secured to a garment.

A kit could permit customization and could be useful to a person who was required to make only one or two types of signals, e.g., turning right and stopping.

Figure 15:
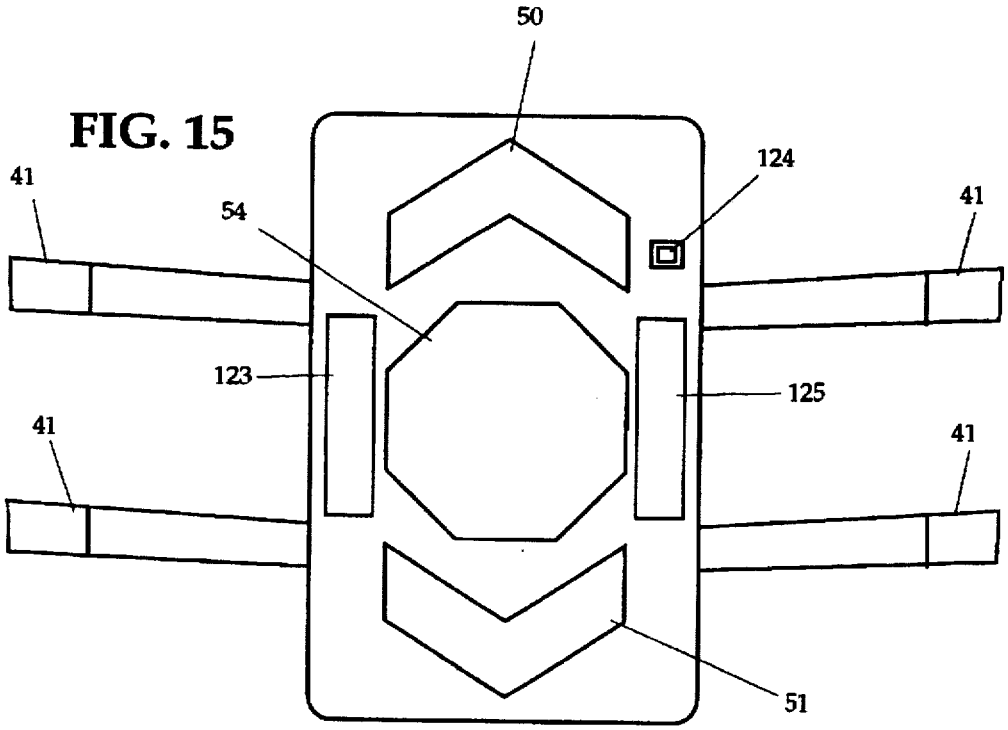
FIG. 15 is a front view of a wearable vehicular signaling system adaptable for fitting on or about a user's arms or legs.

DESCRIPTION AND OPERATION OF A WEARABLE VEHICULAR SIGNALING SYSTEM ADAPTED FOR FITTING ON OR ABOUT A USER'S ARMS OR LEGS—FIG. 15

FIG. 15 shows a wearable vehicular signaling system adaptable for fitting on or about a user's arms or legs.

This unit is provided with direction signaling means capable of indicating the users intention to either commence, continue, or resume forward motion, to turn or bear to the left, to turn or bear to the right, or to stop.

The user could wear one of these units on his or her right arm and one unit on his or her left arm. These units could be secured to the arms by means of straps. A buckle mechanism or mating hook-and-loop fasteners may be used to tighten these straps.

When turned on by way of ON-OFF switch 124, the forward motion direction signaling light subassemblies 50F and 50R would be actuated when the user's arms are not raised. A switching construction 125 that is responsive to the raising of the user's arms would actuate right turn direction signaling light subassemblies 51F and 51R or the left turn direction signaling light subassemblies 52F and 52R when the user raises, respectively, his or her right or left arm.

Brake signal light subassemblies 54F and 54R could be controlled by a switching means that is hand-held, securable to the user's clothing, or responsive to a braking action of the user.

CONCLUSION, RAMIFICATIONS, AND SCOPE

While the above description contains many specificities, these should not be construed as limitations on the scope of the invention, but rather as an exemplification of one or more preferred embodiments thereof.

Many other variations are possible. It should not be understood that the foregoing specification represents the only manner in which to manufacture and use a combination of the essential elements of this wearable vehicular signaling system. For example:

Direction signaling means that may be made to flash with or without the use of an internal light source means may be provided.

The number of direction signaling light subassemblies may range from one provided on only one side of the wearable vehicular signaling system, to a plurality of direction signaling light subassemblies provided on one or both sides thereof.

The signal lights may be made separately or may be made in a single piece.

The signal lights may be secured to a garment, without an interceding material.

The shapes, colors, and arrangements of the signal lights may be varied by one skilled in the art. This might be done to create a more aesthetically appealing or readily manufacturable wearable vehicular signaling system.

Voice actuated control means could be provided.

One or more Light Emitting Diodes may be used in place of bulbs.

Various kinds of circuit means using differing voltages or lamps may be used.

Specific rates of flashing lights may be provided by various circuit means.

One could dispense with flashing device and provide flashable lights by mounting a flashing light bulb in one or more of the signal light subassemblies.

One could also dispense with a main ON-OFF switch means and employ switch subassemblies 90, 91,92, 93, or 94 as both actuation means and control means.

Power means could be provided entirely or in part by a generator means.

A variety of devices including: a clock, watch, stop watch, odometer; pedometer; a sound producing device; a pulse rate measuring device; a thermometer; a rear view mirror; etc. could be combined with the present invention.

It is intended that various changes may be made in this wearable vehicular signaling system in the practical development thereof, if desired. Such changes are comprehended within the range of equivalency of the following claims. The invention, therefore, is not to be restricted except as is necessitated by the prior art.

Accordingly, the scope of this invention should be determined not by the embodiments illustrated but by the appended claims and their legal equivalents.

Having thus described the invention: I claim:

1. A wearable vehicular signaling system adapted and augmented for wearing on or about the body of a person comprising, in part, direction signaling means wherein:

(a) said direction signaling means can be shaped, powered, actuated, and controlled to communicate and signal an intention to commence, continue, or resume forward motion; to turn or bear to the right; to turn or bear to the left; to cross the roadway or highway; or to stop; and (b) said direction signaling means is securable to a garment or other means for wearing on or about the body of a person.

2. The wearable vehicular signaling system as recited in claim 1 wherein the direction signaling means comprises an arrangement of at least one direction signaling light subassembly, wherein said direction signaling light subassembly communicates, when actuated, an intention to commence, continue, or resume forward motion; to turn or bear to the right; to turn or bear to the left; to cross the roadway or highway; or to stop.

3. The wearable vehicular signaling system as recited in claim 2 wherein each direction signaling light subassembly comprises:

(a) a direction signaling light sub assembly housing in which is mounted at least one incandescent lamp or Light Emitting Diode;

(b) a lens secured removably to said direction signaling light sub assembly housing;

(c) and lead wires connected to said incandescent lamp or Light Emitting Diode.

4. The wearable vehicular signaling system as recited in claim 3 wherein the direction signaling light subassemblies are provided in pairs, wherein:

(a) one member of said pair is provided on the front side of the wearable vehicular signaling system and the other member of said pair is provided on the backside thereof, and (b) each of said pairs is capable of being powered, actuated, and controlled so as to communicate or signal an intention to commence, continue, or resume forward motion; to turn or bear to the right; to turn or bear to the left; to cross the roadway or highway; or to stop.

5. The wearable vehicular signaling system as recited in claim 4 wherein:

(a) the direction signaling light subassemblies that communicate or signal an intention to commence, continue, or resume forward motion are arrowhead shaped and oriented on the wearable vehicular signaling system to point upward when said wearable vehicular signaling system is being worn;

(b) the direction signaling light subassemblies that communicate or signal an intention to turn or bear to the right and the direction signaling light subassemblies that signal an intention to turn or bear to the left are arrowhead shaped and oriented on the wearable vehicular signaling system to point toward a wearer's right and left, respectively, when said wearable vehicular signaling system is being worn;

(c) the direction signaling light subassemblies that communicate or signal an intention to cross the roadway or highway is X-shaped; and (d) the direction signaling light subassemblies which communicate or signal an intention to stop are octagonal or rectangular in shape.

6. The wearable vehicular signaling system as recited in claim 5 wherein (a) the lenses of the direction signaling light subassemblies that communicate or signal an intention to commence, continue, or resume forward motion are green in color;

(b) the lenses of the direction signaling light subassemblies that communicate or signal an intention to turn or bear to the right and turn or bear to the left are amber in color;

(c) the lenses of the direction signaling light subassemblies that communicate or signal an intention to cross the roadway or highway is blue in color; and (d) the lenses of the direction signaling light subassemblies which communicate or signal an intention to stop is red in color.

7. The wearable vehicular signaling system as recited in claim 6 wherein means for wearing on or about the body of a person comprises a vest-like garment wherein the front and back panels thereof are joined by shoulder straps and a belt or belts, wherein said straps and a belt or belts are substantially adjustable in length so as to enable said vest-like garment to be worn by a person while said person was wearing a backpack or similar item.

8. The wearable vehicular signaling system as recited in claim 7 wherein the means for wearing on or about the body of a person comprises a vest-like garment wherein the bottom edges of said vest-like garment are cut into triangular points.

9. The wearable vehicular signaling system as recited in claim 8 wherein means for powering the direction signaling means is provided by a battery or batteries or by circuit means which is connectable to a generator means.

10. The wearable vehicular signaling system as recited in claim 9 wherein the battery or batteries resides removably in a battery compartment which is supported by the vest-like garment.

11. The wearable vehicular signaling system as recited in claim 10 wherein means for actuating said direction signaling means is provided by a main ON-OFF switch subassembly.

12. The wearable vehicular signaling system as recited in claim 11 wherein means for controlling the direction signaling lights comprises a switch or switches connected to said main ON-OFF switch, wherein said switch or switches, when closed, actuates at least one of said direction signaling light subassemblies when said main ON-OFF switch is also closed.

13. The wearable vehicular signaling system as recited in claim 12 wherein a circuit means interconnects the direction signaling lights, the means for power, the means for actuating said direction signaling lights, and the means for controlling said direction signaling lights which should now proceed the world "lights".

14. The wearable vehicular signaling system as recited in claim 13 wherein the circuit means comprises circuit wires and a flashing device such as an incandescent flasher.

15. A wearable vehicular signal light unit, suitable for inclusion in a kit, comprising, in combination:

(a) direction signaling means which may be secured to a garment and which can be powered, actuated, and controlled so as to communicate or signal an intention to commence, continue, or resume forward motion; to turn or bear to the right; to turn or bear to the left; to cross the roadway or highway; or to stop;

(b) means for controlling said direction signaling means;

(c) means for actuating said direction signaling means;

(d) a battery compartment; and (e) circuit means interconnecting said direction signaling means, said power means, said means for actuating said direction signaling means, and said means for controlling said direction signaling means.

16. The wearable vehicular signaling system as recited in claim 15 wherein each direction signaling light subassembly comprises a signal light housing in which is mounted at least one incandescent lamp or Light Emitting Diode, a clear or colored lens secured removably to said signal light housing, and lead wires connected to said incandescent lamp or Light Emitting Diode.

17. The wearable vehicular signaling system as recited in claim 16 wherein the signal light subassembly is shaped and capable of being oriented upon a garment so to as to enable said direction signaling light subassembly to indicate, when actuated, an intention to commence, continue, or resume forward motion, to turn or bear to the right, to turn or bear to the left, to cross the roadway or highway.

18. The wearable vehicular signaling system as recited in claim 17 wherein means for powering said lamp or Light Emitting Diode comprises a battery residing removably in a battery compartment or a circuit means which is connectable to a generator means.

19. The wearable vehicular signaling system as recited in claim 18 wherein means for securement to a garment comprises an opening or openings along the edges of said unit through which said unit may be stitched to a garment, mating hook-and-loop fasteners secured said unit, other securement expedients.

20. A wearable vehicular signaling system, adapted for fitting on or about the arms or legs of a user, comprising:

(a) direction signaling means which is securable to a human limb and capable of being powered, actuated, and controlled so as to communicate or signal an intention to commence, continue, or resume forward motion; to turn or bear to the right; to turn or bear to the left; to cross the roadway or highway; or to stop comprising at least one arrowhead shaped, X-shaped, or octagonal signal light subassembly;

(b) means for powering said direction signaling means comprising one or more batteries residing removably in a battery compartment or circuit means which is connectable to a generator means;

(c) means for actuating said direction signaling means comprising a main ON-OFF switch;

(d) means for controlling said direction signaling means comprising, in part: a switching mechanism that is responsive to the movement of the wearer; a switching means that is responsive to a braking or stopping action; a switching means that is hand-held; or a combination thereof;

(e) circuit means interconnecting said direction signaling means, said power means, said means for actuating said direction signaling means, and said means for controlling said direction signaling means.

21. The wearable vehicular signaling system of claim 11 wherein the means for securement to the body comprises a belt or strap.

22. The wearable vehicular signaling system as recited in any one of claims 1, 15 or 20 wherein the means for controlling the direction signaling means is removably secured to said garment and is provided with securement means whereby said means for controlling the direction signaling means is securable to the handlebars or frame of a bicycle.

23. The wearable vehicular signaling system as recited in any one of claims 1, 15, 20, wherein the means for controlling the direction signaling means is hand-held or securable to the hand or arm.

24. A method for making oncoming motorists and others aware of a person's intention to commence, continue, or resume forward motion; to turn or bear to the right or left; to cross the roadway or highway; or stop, comprising the steps of:

(a) securing a light or lights to a garment or other means for wearing on or about the body of a person, wherein said light or lights is shaped, arranged, powered, and actuatable to communicate a visually intelligible signal of said person's intention to commence, continue, or resume forward motion; to turn or bear to the right or left; to cross the roadway or highway; or stop, and (b) actuating said light or lights before acting in the manner equivalent to said signal's meaning, that is to say, (1) actuating the signal light which communicates an intention to commence or continue forward motion before undertaking the action of commencing, continuing, or resuming forward motion;

(2) actuating the signal light which communicates an intention to turn or bear to the right before undertaking the action of turning or bearing to the right;

(3) actuating the signal light which communicates an intention to turn or bear to the left before undertaking the action of turning or bearing to the left;

(4) actuating the signal light which communicates an intention to cross the roadway or highway before undertaking the action of crossing the roadway or highway; and (5) actuating the signal light which communicates an intention to stop before undertaking the action of stopping.

* * * * *